US005411428A

United States Patent [19]

Orii et al.

[11] Patent Number: 5,411,428

[45] Date of Patent: May 2, 1995

[54] BLOCK UNITS FOR A BLOCK TOY

[75] Inventors: Makoto Orii; Katsuhiko Hayashi, both of Nagano, Japan

[73] Assignee: Kabushiki Kaisha Sankyo Seiki Seisakusho, Nagano, Japan

[21] Appl. No.: 119,389

[22] Filed: Sep. 13, 1993

[30] Foreign Application Priority Data

Sep. 16, 1992 [JP] Japan ..... 4-246344

[51] Int. Cl.[6] ..... A63H 33/08

[52] U.S. Cl. ..... 446/90; 446/95; 446/128; 446/102

[58] Field of Search ..... 446/90, 95, 128, 124, 446/125, 102, 103

[56] References Cited

U.S. PATENT DOCUMENTS

| | | | |
|---|---|---|---|
| 3,236,004 | 2/1966 | Christiansen | 446/120 X |
| 3,484,983 | 12/1969 | Fischer | 446/90 |
| 4,813,903 | 3/1989 | Furukawa et al. | 446/90 |
| 4,998,903 | 3/1991 | Bolli et al. | 446/128 X |

FOREIGN PATENT DOCUMENTS

| | | |
|---|---|---|
| 2321733 | 3/1977 | France . |
| 2536988 | 3/1977 | Germany . |
| 2185192 | 7/1987 | United Kingdom . |

*Primary Examiner*—Mickey Yu

*Attorney, Agent, or Firm*—Sughrue, Mion, Zinn, Macpeak & Seas

[57] ABSTRACT

A block unit for a block toy contains a block body having protrusions and recesses through which the block body is freely connectable to other block units; a rotary shaft rotatably supported in the block body in such a manner that the rotary shaft is extended in a block coupling direction in which the block unit is coupled to other block units through the protrusions and recesses thereof; and a rotation transmitting mechanism for transmitting the rotation of the rotary shaft to other block bodies coupled to the block unit body, the rotation transmitting mechanism provided at the ends of the rotary shaft, the rotation transmitting mechanism being freely connectable to rotation transmitting mechanism of other block units. The block unit may include a drive source such as an electric motor mounted therein.

11 Claims, 7 Drawing Sheets

BLOCK UNITS FOR A BLOCK TOY

BACKGROUND OF THE INVENTION

1. Field of the Invention

This invention relates to block units for a block toy.

2. Related Art

A block toy is well known which is formed by combining block units having protrusions and recesses. There are available a variety of block units different in configuration for block toys; however, the standard structure of a block unit is as shown in FIG. 10(*a*). That is, the body of the block unit (hereinafter referred to as "a block body", when applicable) is in the form of a rectangular box made up of two end walls, two side walls, and a top wall, being opened in one direction. The block body has eight protrusions 3*a* through 3*h* on the outer surface of the top wall at equal intervals. Furthermore, FIG. 10(*c*), it has three annular protrusions 4*a*, 4*b* and 4*c* (hereinafter referred to as "tubes 4*a*, 4*b* and 4*c*", when applicable) extended from the inner surface of the top wall, which is opposite to the outer surface of the wall on which the eight protrusions are formed, to the plane defined by the outer edges of the two end walls and two side walls of the block body. The two end walls and two side walls of the block unit and the tubes 4*a*, 4*b* and 4*c* define a recess a. The block unit shown in FIG. 10(*c*) is relatively small in thickness. The block unit shown in FIG. 10(*a*) is standard in thickness, and its tubes have a length in proportion to the thickness.

The block units shown in FIG. 10(*a*) and (*b*) are joined into one unit as follows. That is, the block unit shown in FIG. 10(*a*) or (*b*) is turned over and set on the block unit shown in FIG. 10(*a*) or (*b*). Under this condition, those block units are pushed against each other, as a result of which three spaces A, B and C defined on the top wall by the eight protrusions (each space being defined by four adjacent protrusions) are engaged with the three tubes 4*a*, 4*b* and 4*c*, respectively, so that the two block units are connected to each other. In this operation, the protrusions of the block unit of FIG. 10(*c*) are engaged with the recess a which is defined by the four side walls and the three tubes. The two block units may be connected to each other in various manners. For instance, the two block units are set in the same direction, and one of the tubes of one of the block units is engaged with one of the above-described spaces on the top wall of the other block unit, or two tubes are engaged with two spaces.

On the other hand, a moving block toy is available in which a drive source, namely, an electric motor is built in a block unit (hereinafter referred to as "a motor block unit", when applicable). The motor block unit is several times as large in size as the standard block unit. The motor is built in the block unit in such a manner that the rotary shaft of the motor is arranged perpendicular to the direction of engagement (or disengagement) of the block unit, and its both end portions are protruded from the block unit. Rotating members such as tires, gears, belts and pulleys are mounted on the two end portions of the rotary shaft. With moving block toys, a variety of structures can be formed which are movable. The moving block toys are objects in which children full of curiosity are interested.

The conventional motor block unit, having its rotary shaft sticking out of the block body, suffers from the following difficulties: If, with the motor block unit coupled to a battery block unit, the switch is turned on, then the motor's rotary shaft sticking out of the block body is rotated, thus being hazardous. If the rotary shaft sticking out of the block body is bent by external force, then it becomes impossible to accurately transmit the torque to the rotating member such as a tire. Since the end portions of the rotary shaft are protruded from the block body, the motor block unit is a special block unit; that is, it cannot be employed as a standard block unit, not being applicable to different moving block toys. Furthermore, since the direction of the rotary shaft is perpendicular to the direction of engagement of the block unit, the direction of utilization of the torque provided by the motor is limited; that is, use of the motor block unit is limited.

SUMMARY OF THE INVENTION

Accordingly, an object of this invention is to provide a block unit for a block toy which can be handled safely and has a wide range of applications.

According to an aspect of the present invention, there is provided a block unit for a block toy comprising: a block body having protrusions and recesses through which the block body is freely connectable to other block units; a rotary shaft rotatably supported in the block body in such a manner that the rotary shaft is extended in a block coupling direction in which the block unit is coupled to other block units through the protrusions and recesses thereof; and rotation transmitting means for transmitting the rotation of the rotary shaft to other block bodies coupled to the block unit body, the rotation transmitting means provided at the ends of the rotary shaft, the rotation transmitting means being freely connectable to rotation transmitting means of other block units.

In the block unit according to the invention, the rotary shaft is extended in the block coupling direction. Therefore, when the block units are engaged with each other, the rotary shafts thereof are automatically engaged with each other. Furthermore, since the rotary shaft is not protruded outside the block body, the block unit can be handled safely, and the rotary shaft is prevented from being bent or broken.

In addition, in the block unit of the invention, the drive source is built in the conventional block body standard in size. Therefore, in the case where a block toy has been formed with the block units of the invention, the latter may be replaced with the conventional standard block units.

Furthermore, in the block unit of the invention, the rotation transmitting means are energized so as to be engaged with those of other block units. Hence, the torque is positively transmitted between the block units engaged with each other.

BRIEF DESCRIPTION OF THE DRAWINGS

FIG. 1(*b*) is a perspective view showing a gear block unit of type B, which constitutes a second embodiment of the invention;

FIG. 1(*c*) is a perspective view showing a gear block unit of type C, which constitutes a third embodiment of the invention;

FIG. 1(*d*) is a perspective view showing a gear block unit of type D, which constitutes a fourth embodiment of the invention;

FIG. 1(*e*) is a perspective view showing a block unit of type E, which constitutes a fifth embodiment of the invention;

DETAILED DESCRIPTION OF THE PREFERRED EMBODIMENTS

Figure 1A:
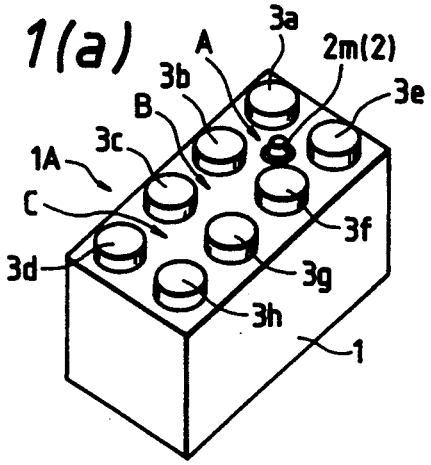
FIG. 1(*a*) is a perspective view showing a motor block unit, which constitutes a first embodiment of the invention.
Figure 1D:
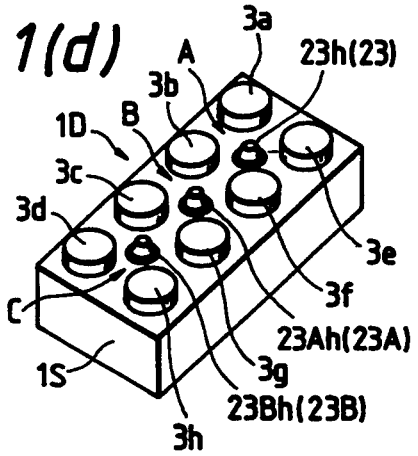
Figure 1B:
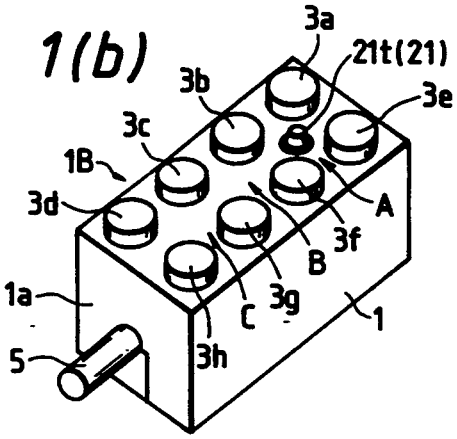
Figure 1E:
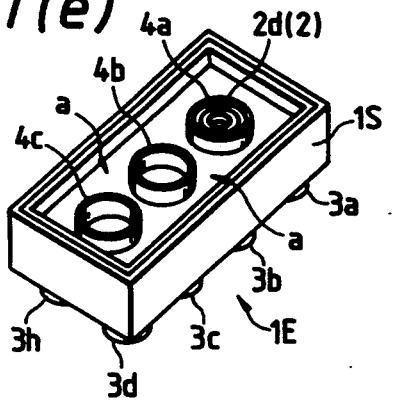
Figure 1C:
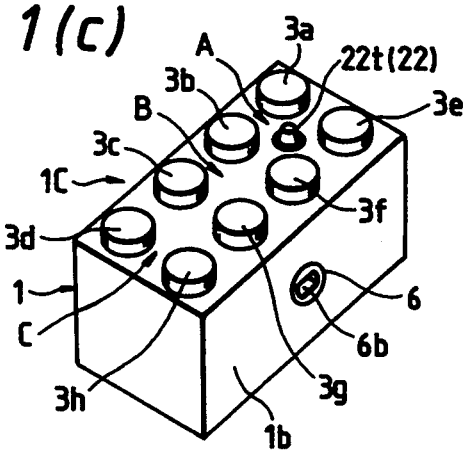

Several types of block units according to this invention will be described with reference to Figure.

FIGS. 1(*a*) through (*c*) show first, second and third types of block units according to the invention, in each of which a rotary shaft is built in a block body 1 standard in size which is made up of two end walls, two side walls and a top wall (hereinafter referred to as "a standard block body 1", when applicable). FIGS. 1(*d*) and (*e*) show fourth and fifth types of block units according to the invention, in which a rotary shaft is built in a block body 1S smaller in size than the block body 1 (hereinafter referred to as "a small block body 1S", when applicable). The block body 1S is also made up of two end walls, two side walls and a top wall. The standard block body 1 and the small block body 1S are different from each other only in thickness in the direction of engagement (or disengagement) of the block units (hereinafter referred to as "a block coupling direction", when applicable). The block bodies 1 and 1S each have eight protrusions 3*a* through 3*h*, and three tubes 4*a* through 4*c* in the same manner. That is, the positions of the protrusions and the tubes of the block body 1 are the same as those of the protrusions and the tubes of the block body 1S.

The diameter of the tube 4*a* is slightly larger than the diameter of a phantom circle touching the outer cylindrical surfaces of the four adjacent protrusions 3*a*, 3*b*, 3*e* and 3*f*. The tube 4*a* is provided on the inner surface of the top wall in such a manner that it is in alignment with a space A which is defined on the outer surface of the top wall by the aforementioned phantom circle. Similarly, the tubes 4*b* and 4*c* are provided on the inner surface of the top wall in such a manner as to be in alignment with spaces B and C which are defined on the outer surface of the top wall in the same manner. The tubes 4*a*, 4*b* and 4*c* are relatively large in wall thickness, and are elastically deformable.

FIG. 1(*a*) shows a first embodiment of the invention; that is, a motor block unit 1A in which a drive source such as an electric motor or spring motor is built. One end portion (or a rotation transmitting end portion) of the rotary shaft 2 is protruded in the space A which is defined by the four adjacent protrusions 3*a*, 3*b*, 3*e* and 3*f*.

FIG. 1(*b*) shows a second embodiment of the invention; that is, a gear block unit of type B, namely, a gear block unit 1B in which a gear unit is built. One end portion of the rotary shaft 21 is protruded in the space A from the top wall, and the output shaft 5 is protruded from one end wall 1*a* of the block body 1.

FIG. 1(*c*) shows a third embodiment of the invention; that is, a gear block unit of type C, namely, a gear block unit 1C in which a gear unit is built. One end portion of the rotary shaft 22 is protruded in the space A from the top wall, and one end portion of the output shaft 6 is protruded from one side wall 1*b* of the block body 1.

FIG. 1(*d*) shows a fourth embodiment of the invention; that is, a gear block unit of type D, namely, a gear block unit 1D in which a gear unit is built. First end portions of three rotary shafts 23, 23A and 23B are protruded in the spaces A, B and C from the top wall. In the block unit, the torque applied to any one of the three rotary shafts is outputted through the others.

FIG. 1(*e*) shows a fifth embodiment of the invention; that is, a block unit of type E, namely, a block unit 1E in which the other end portion of the rotary shaft 24 is positioned in the tube 4*a*. The block unit 1E is connected between two block units having rotary shafts, to transmit torque therebetween.

The structures of the aforementioned block units will be described in detail.

Figure 2:
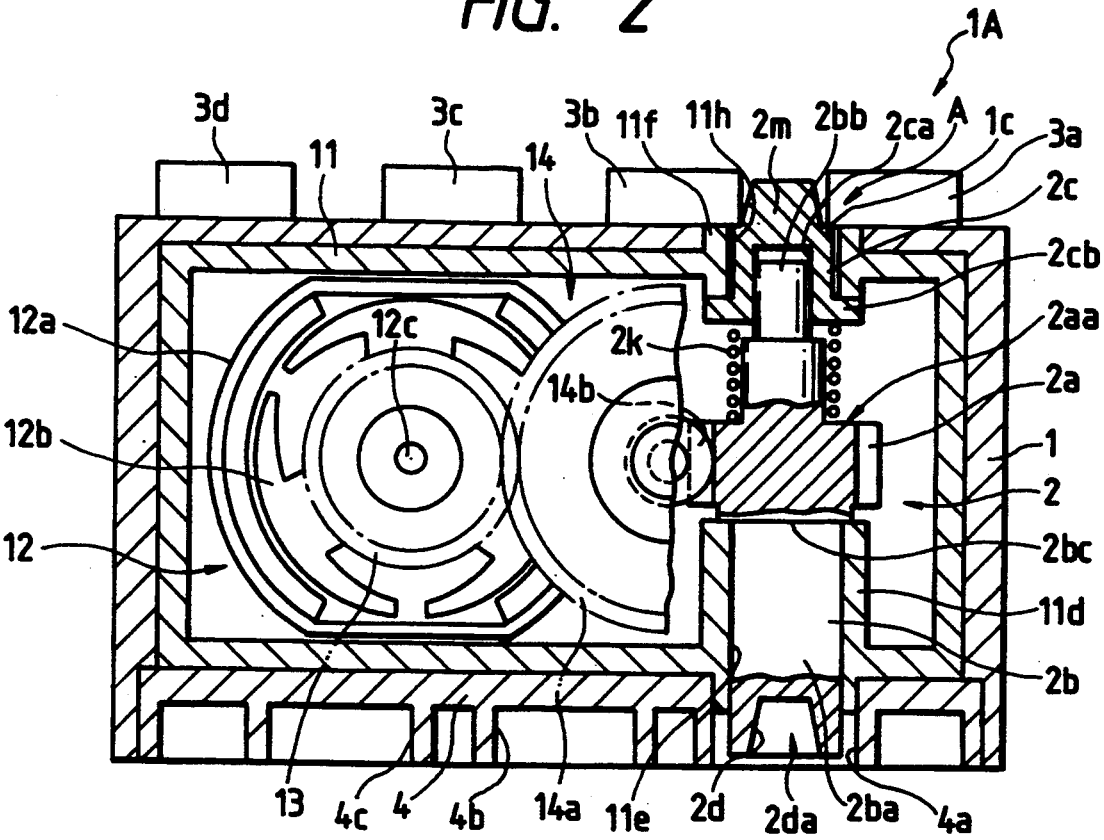
FIG. 2 is a vertical sectional view of the motor block unit.
Figure 3:
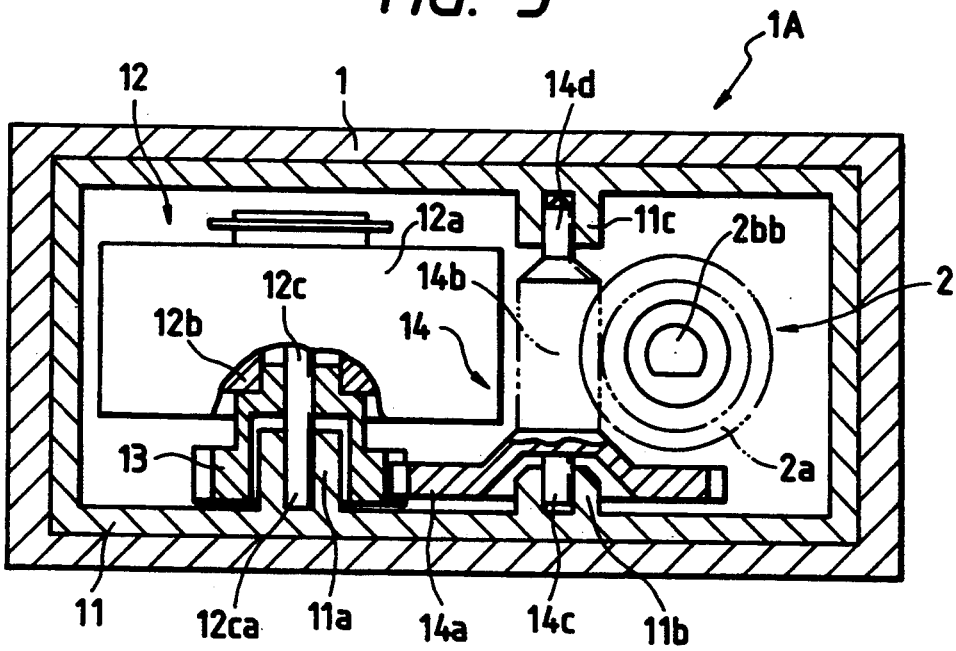
FIG. 3 is a horizontal sectional view of the motor block unit.

The motor block unit 1A, the first embodiment, is as shown in FIGS. 2 and 3.

A unit casing 11, which rotatably supports the rotary shaft 2, is fitted inside the block body 1. The unit casing 11 is prevented from coming off the block body by means of a tube plate 4, which is fitted in the block body 1 and then secured to it with adhesive or other means. The tube plate 4 has the tubes 4*a*, 4*b* and 4*c*. The drive source, namely, the electric motor 12 is built in the unit case 11. The motor 12 is a DC motor comprising a stator 12*a* including magnets, and a rotor 12*b*. The stator 12*a* is secured to the unit casing 11. The rotor 12*b* is rotatably supported by a motor supporting shaft 12*c*, the base end portion 12*ca* of which is fixedly fitted in a supporting portion 11*a* of the unit casing 11. Furthermore, the rotor 12*b* is fixedly secured to a drive gear 13. The drive gear 13 is engaged with a large diameter gear 14*a* of a reduction gear unit 14. The reduction gear unit 14 has the large diameter gear 14*a* and a worm 14*b* integral with the latter 14*a*. The unit casing 11 has bearing portions 11*b* and 11*c* which rotatably support both end portions 14*c* and 14*d* of the reduction gear 14. The worm 14*b* is engaged with a worm wheel 2*a* of the rotary shaft 2.

The rotary shaft 2 comprises: a first shaft part 2*b* which is integral with the worm wheel; and a second shaft part 2*c* which is engaged with the first shaft part 2*b* in such a manner that it is axially slidable and it becomes integral with the first shaft portion 2*b* when turned. One end portion 2*ba* of the first shaft part 2*b* is rotatably supported by a bearing hole 11*e* formed in a bearing portion 11*d* of the unit casing 11. A tapered or conical hole trapezoid in section, namely, a first rotation transmitting means 2*d* is formed in the end face of the first shaft part 2*b*. The outer end portion of the bearing portion 11*d* is extended through the tube plate 4 and engaged with the tube 4*a*. That is, the first rotation transmitting means 2*d* is positioned inside the tube 4*a*. The worm 14*b* and the worm wheel 2*a* are provided in the reduction gear train between the motor 12 and the rotary shaft 2 in the above-described manner, and therefore a large reduction ratio and a great torque can be obtained with a small number of parts.

The second shaft part 2*c* is rotatably and slidably fitted in a bearing hole 11*h* formed in a bearing portion 11*f* of the unit casing 11, and engaged with the other end portion 2*bb* of the first shaft part 2*b*. The other end portion 2*bb* of the first shaft part 2*b* is substantially D-shaped in section, and therefore the engaging hole 2*ca* of the second shaft part 2*c*, with which the other end portion 2*bb* is engaged, is also D-shaped in section. The bearing portion 11*f* is fitted in a through-hole 1*c* which is formed in the top wall at the space A. The second shaft part 2*c* includes a second rotation transmitting means 2*m* which is conical, and trapezoid in section. The means 2*m* is protruded in the space A on the top wall.

A compression coil spring 2*k* is wound on the first shaft part 2*b*, to urge the first shaft part 2*b* and the second shaft part 2*c* outwardly of the unit casing 11 (i.e., to couple the block units together). Both ends of the coil spring 2*k* are held abutted against the end face 2*aa* of the worm wheel 2*a* and the flange 2*cb* of the second shaft part 2*c*, respectively. The lengths of the first shaft part 2*b* and second shaft part 2*c* are so selected that, when those shaft parts 2*b* and 2*c* are pushed against the elastic force of the coil spring 2*k* inwardly of the unit casing 11, they are moved to decrease the length of the rotary shaft 2.

The first shaft part 2*b* urged by the coil spring 2*k* is regulated in movement with its step 2*bc* abutted against the end face of the bearing portion 11*d*. The end face 2*da* of the first rotation transmitting means 2*d* of the rotary shaft 2 which is regulated in movement is set back from the end face of the tube 4*a*. On the other hand, the second shaft part 2*c* is regulated in movement with its flange 2*cb* abutted against the end face of the bearing portion 11*f*. The end face of the second rotation transmitting means 2*m* of the rotary shaft 2, which is regulated in movement, is set back from the end faces of the protrusions 3*a* and 3*b*.

The function of the motor block unit 1A will be described with reference to FIGS. 2 and 3. When the motor 12 is switched on with the block unit 1A electrically connected to the battery block unit (not shown), the rotation of the motor 12 is transmitted through the drive gear 13 to the reduction gear 14 with its speed reduced. The rotation of the reduction gear is transmitted through the worm 14*b* to the worm wheel 2*a*, so that the speed of rotation is further reduced. The rotation of the rotary shaft 2 is taken outside the block body through the first rotation transmitting means 2*d* of the first shaft part 2*b* and through the second rotation transmitting means 2*m* of the second shaft part 2*c* which is equal in the direction of rotation to the first shaft part 2*b*. In this operation, the block unit is safe, because the end portions (2*d* and 2*m*) of the rotary shaft 2 which is being rotated are not protruded above the tube 4*a* and the protrusions 3*a* and 3*b*. A method of connecting other block units to the first rotation transmitting means 2*d* and the second rotation transmitting means 2*m* of the rotary shaft 2 will be described later.

The structure of the gear block unit 1B, the second embodiment of the invention, will be described with reference to FIG. 4.

The gear block unit 1B comprises: the rotary shaft 21 extended in the block coupling direction; the output shaft 5 arranged perpendicular to the rotary shaft 21; and a reduction gear train provided between the rotary shaft 21 and the output shaft 5. The tube plate 4 secured to the block body 1 has a bearing hole 4*d* which is coaxial with the tube 4*a* and opened in the latter 4*a*. Another bearing hole 1*d* is formed in the top wall of the block body 1 in such a manner that it opens in the space A.

The rotary shaft 21 comprises a first shaft part 21*a* and a second shaft part 21 which are axially slidable, and are turned as one unit. The first shaft part 21*a* has a worm 21*c*. A tapered hole trapezoid in section, namely, a first rotation transmitting means 21*d* is formed in the end face of one end portion of the first shaft part 21*a*. The first shaft part 21*a* has a flange 21*e* which is abutted against the end face of a boss of the tube plate 4 which defines the bearing hole 4*d*, and a flange 21*h* on which one end of a coil spring 21*f* is set. The other end portion 21*m* of the first shaft part 21*a*, which is smaller in diameter, is substantially D-shaped in section.

On the other hand, the second shaft part 21*b* has an engaging hole 21*n* substantially D-shaped in section, which is slidably engaged with the end portion 21*m* of the first shaft part 21*a*. The second shaft part 21*b* has a flange on which the other end of the coil spring 21*f* is set, and a second rotation transmitting means 21*t* which is conical, and substantially trapezoidal in section. The coil spring 21*f* urges the first shaft part 21*a* and the second shaft part 21*b* to push the flanges 21*e* and 21*s* against the bearing portions. Under this condition, the first rotation transmitting means 21*d* and the second rotation transmitting means 21*t* are held set back from the end face of the tube 4*a* and the end faces of the protrusions 3*a* and 3*b*, respectively.

The output shaft 5 has a small diameter end portion 5*a*, which is inserted into a bearing hole 1*e* formed in the end wall 1*a* of the block body 1. The other end portion 5*b* of the output shaft 5 is supported between bearing portions 1*f* and 4*e* of the block body 1 and the tube plate 4. That is, the output shaft 5 is supported in such a manner that it is freely rotatable, but it is prevented from being moved axially. A bevel gear 5*c* is integrally mounted on the inner end portion of the output shaft. The length of the portion of the output shaft which is extended outside the block body 1 is adjusted according to an end item which is formed by using the gear block unit. The output shaft 5 may be terminated at the outer surface of the end wall la of the block as the case may be. However, in this case, a coupling engaging hole should be formed in the end wall (cf. 6*b* in FIG. 1(*c*)).

The bevel gear 5*c* is engaged with another bevel gear 5*d*. The bevel gear 5*d* has a worm wheel 5*e*, which is engaged with the worm 21*c* of the rotary shaft 21*c*. The shaft 5*f* of the bevel gear 5*d* and the worm wheel 5*e* is rotatably supported by the block body 1.

When the rotary shaft 21 is rotated by a motor block unit (not shown) connected to the first rotation transmitting means 21*d*, the worm 21*c* of the rotary shaft 21 rotates the bevel gear 5*d* through the worm wheel 5*e* with the speed of rotation reduced. The rotation of the bevel gear 5*d* is transmitted through the bevel gear 5*c* to the output shaft 5 to turn the latter 5. If, in this case, a rotating member is connected to the second rotation transmitting means 21*t*, it is also turned.

That is, with the gear block unit 1B, the torque inputted thereto is outputted through the rotary shaft 21 as it is, or it can be transmitted in the longitudinal direction of the block unit with the aid of the bevel gears which direction is perpendicular to the block coupling direction. If the ends portions of the shaft 5*f* of the worm wheel 5*e* and the bevel gear 5*d* are extended through the side walls of the block body 1 so that they can be coupled to rotating members, then the torque can be transmitted three-dimensionally.

The gear block unit 1C, the third embodiment of the invention, will be described with reference to FIG. 5.

The gear block unit 1C comprises: a rotary shaft 22 extended in the block coupling direction; and an output shaft arranged perpendicular to the rotary shaft 22. The tube 4*a* formed on the tube plate 4 secured to the block body 1 is not closed at the base end; that is, a bearing hole 4*d* is formed in the tube plate 4 secured to the block body 1 in such a manner that it is coaxial with the tube 4*a* and opened in the latter 4*a*. Another bearing hole 1*d* is formed in the block body's top wall at the position corresponding to the space A.

The rotary shaft 22 comprises: a first shaft part 22*a* and a second shaft part 22*b* which are axially slidable and turned as one unit. The first shaft part 22*a* has a worm 22*c*. A tapered hole substantially trapezoid in section, namely, a first rotation transmitting meas 22*d* is formed in the end face of one end portion of the first shaft part 22*a*. The first shaft part 22*a* has a flange 22*e* which is abutted against the end face of the bearing portion defining the aforementioned bearing hole 4*d*, and another flange 22*h* on which one end of a coil spring 22*f* is set. The other end portion 22*m*, smaller in diameter, of the first shaft part 22 is substantially D-shaped in section.

The second shaft part 22*b* has an engaging hole 22*n* which is formed in the end face of its one end portion. The engaging hole 22*n* is substantially D-shaped in section and is slidably engaged with the end portion 22*m* of the first shaft part 22*a*. The second shaft part 22*b* has a flange 22*s* on which the other end of the coil spring 21*f* is set, and a second rotation transmitting means 22*t* which is conical, and substantially trapezoid in section. The coil spring 22*f* urges the first and second shaft parts 22*a* and 22*b* to be moved away from each other, so that the flanges 22*e* and 22*s* are abutted against the end faces of the respective bearing portions. Under this condition, the end faces of the first and second rotation transmitting means 22*d* and 22*t* are set back from the end faces of the tube 4*a* and the protrusions 3*a* and 3*b*.

The output shaft 6 is rotatably supported by the two side walls 1*b* of the block body 1 (only one side wall 1*b* shown in FIG. 1(*c*)). The output shaft 6 has a worm wheel 6*a*, which is engaged with the worm 22*c* which is formed on the rotary shaft 22. Elongated holes 6*b* are formed in both end portions of the output shaft 6, so that rotating members such as tire wheels and caterpillar sprockets are connected to the output shaft by inserting their connecting parts into the elongated holes. As shown in FIG. 1(*c*), the end portions of the output shaft are limited in length so that they may not be protruded outside the side walls 1*b* of the block body 1.

Figure 5:
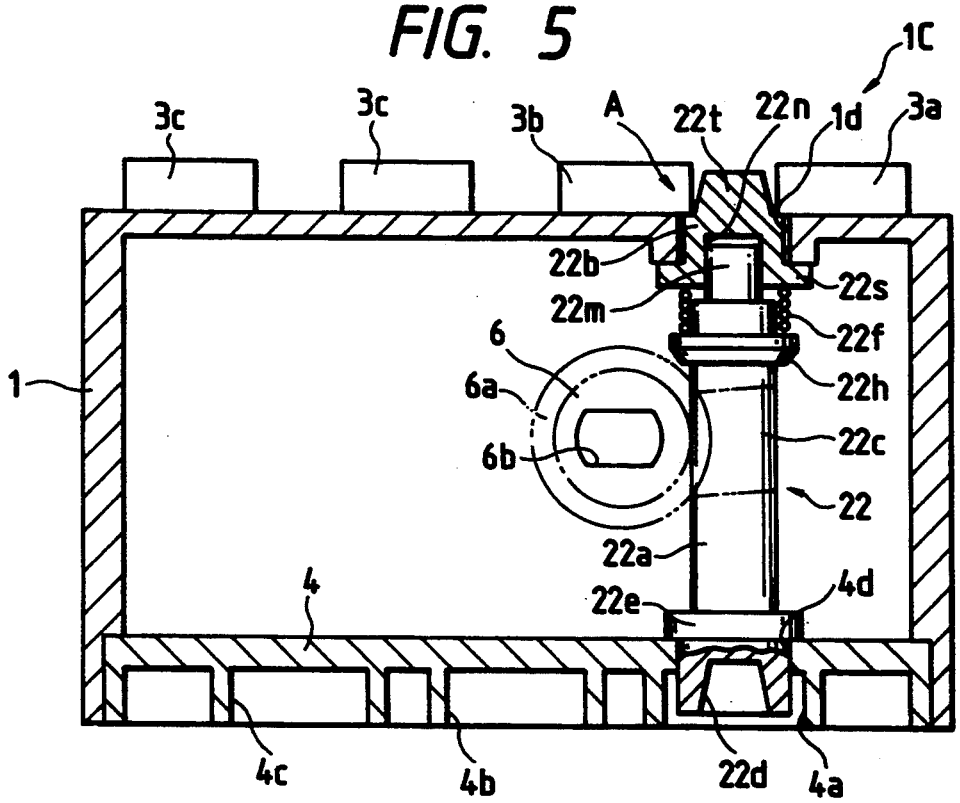
FIG. 5 is a vertical sectional view of the gear block unit of type C.

When, in FIG. 5, the rotary shaft 22 is rotated by a motor block unit (not shown) connected to the first rotation transmitting means 22*a*, the worm 22*c* of the rotary shaft 22 rotates the output shaft 6 through the worm wheel 6*a* with the speed of rotation reduced. The output shaft 6, being driven by the worm 22*c*, is rotated with great torque. If, in this case, a rotating member is coupled to the second rotation transmitting means 22*t*, then it is turned. That is, with the gear block unit 1C, the torque applied in the block coupling direction can be taken out at the side walls of the block body which are perpendicular to the block coupling direction.

The gear block unit 1D, the fourth embodiment of the invention, will be described with reference to FIG. 6.

A tube plate 4 is fixedly fitted in the block body 1S. Bearing holes 1S*a*, 1S*b* and 1S*c* are formed in the top wall of the block body 1S respectively at positions corresponding to the spaces A, B and C. Bearing holes 4*d*, 4*e* and 4*f* are formed in the tube plate 4 in such a manner that they are coaxial with the tubes 4*a*, 4*b* and 4*c* which are positioned in correspondence to the spaces A, B and C on the top wall of the block body. That is, the bearing holes 1S*a*, 1S*b* and 1S*c* are in alignment with the bearing holes 4*a*, 4*b* and 4*c*, respectively. Rotary shafts 23, 23A and 23B are rotatably supported by the pairs of bearing holes 1S*a* and 4*a*, 1S*b* and 4*b*, and 1S*c* and 4*c*, respectively.

Those rotary shafts are equal in structure to one another. Therefore, the rotary shaft 23 will be described as a typical example of them. As for the remaining rotary shafts 23A and 23B, parts corresponding functionally to those which have been described with reference to the rotary shaft 23 are therefore designated by the same reference numerals or characters. The rotary shaft 23 comprises: a first shaft part 23*a* and a second shaft part 23*b* which are axially slidable and turned as one unit. The first shaft part 23*a* has a gear 23*c*, and a first rotation transmitting means 23*d*. The first rotation transmitting means 23*d* is protruded into the tube 4*a*, and has a tapered hole trapezoid in section.

The second shaft part 23*b* has an engaging hole 23*b* D-shaped in section which is slidably engaged with the end portion 23*e* D-shaped in section of the first shaft part 23*a*, a flange 23*f*, and a second rotation transmitting means 23*h* which is conical, and trapezoid in section. A coil spring 23*k* is elastically interposed between the gear 23 of the first shaft part and the flange 23*f* of the second shaft part so as to move the first and second shaft parts away from each other. The movement of the first shaft part 23*a* is limited with the end face of the gear 23*c* abutted against the end face of the bearing portion. The movement of the second shaft part 23*b* is also limited with the flange 23*f* abutted against the end face of the bearing portion.

The gears 23*c*, 23A*c* and 23B*c* of the rotary shafts 23, 23A and 23B are engaged with one another. The end faces of the first rotation transmitting means 23*d*, 23A*d* and 23B*d* and the second rotation transmitting means 23*h*, 23A*h* and 23B*h* of the rotary shafts 23, 23A and 23B are set back from the end faces of the tubes 4*a*, 4*b* and 4*c* and the protrusions 3*a*, 3*b* and 3*c*.

Figure 6:
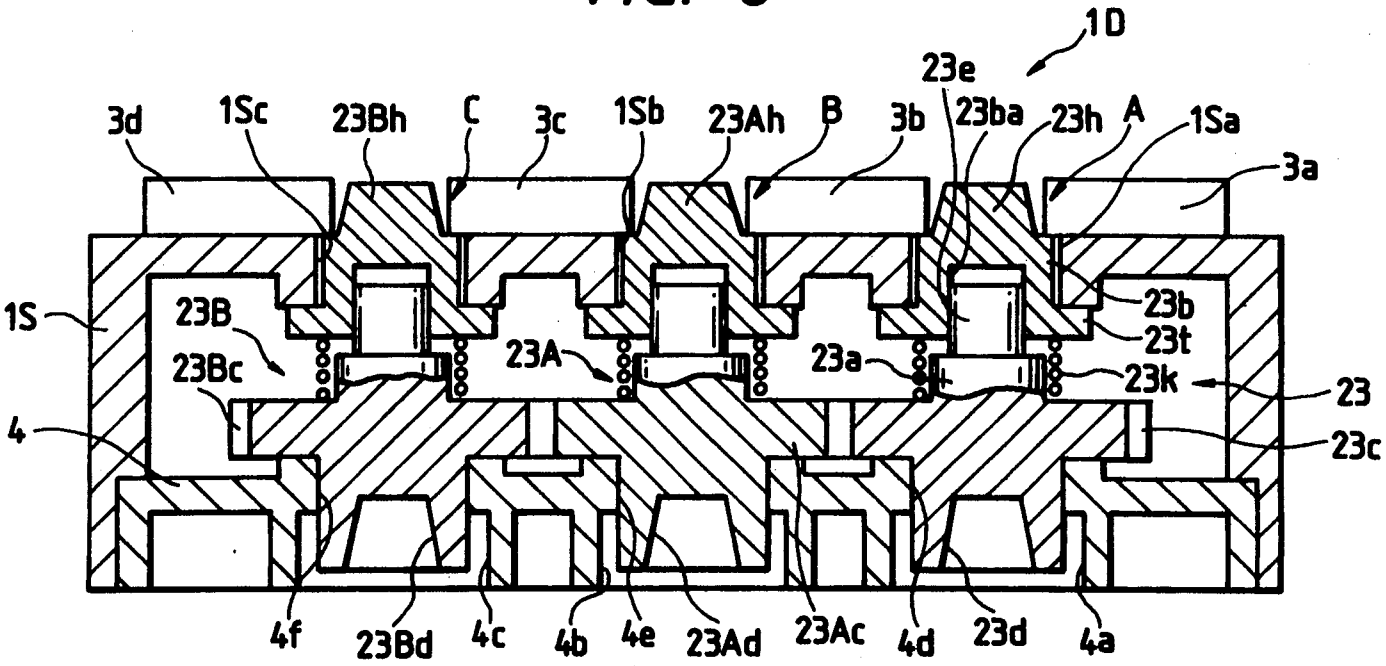
FIG. 6 is a vertical sectional view of the gear block unit of type D.

When, in FIG. 6, for instance the rotary shaft 23 is rotated by the motor block unit (not shown) whose rotary shaft is connected to it, the rotation of the rotary shaft 23 is transmitted through the gear 23*c* and the gear 23A*c* engaged with the latter 23*c* to the rotary shaft 23A, so that the latter 23A is rotated. The rotation of the rotary shaft 23A is transmitted through the gears 23A*c* and 23B*c* to the rotary shaft 23B. Hence, if rotating members have been coupled to those rotary shafts 23, 23A and 23B, then they are rotated.

In each of the rotary shafts of the gear block unit 1D shown in FIG. 6, the coupling state of the first shaft part and the second shaft part is the same as in the other gear block units described above. The gear block unit 1D shown in FIG. 6 is of three-axes drive type; however, the rotary shafts and the gears may be combined in various manners. For instance gear block units of the following types may be considered: a first two-shafts drive type (A) that the rotary shaft 23B is eliminated; that is, only the rotary shafts 23 and 23C are employed; a second two-shafts drive type (B) that the rotary shaft 23B has no gear, and the rotary shafts 23 and 23A are coupled through the gears; a three-shafts relay type that none of the three shafts have gears; a two-shafts relay type that two rotary shafts having no gear are employed; and a single-shaft relay type that only one rotary shaft is employed as shown in FIG. 1(*e*) which constitutes the fifth embodiment of the invention.

In addition, a gear block unit of another type may be considered that the rotation transmitting means 23A*h* of the rotary shaft 23A is not protruded in the space B, because sometimes it is necessary to engage a first block unit with a second block unit in such a manner that the open edge of the first block unit comes in the space B of the second block unit.

Figure 4:
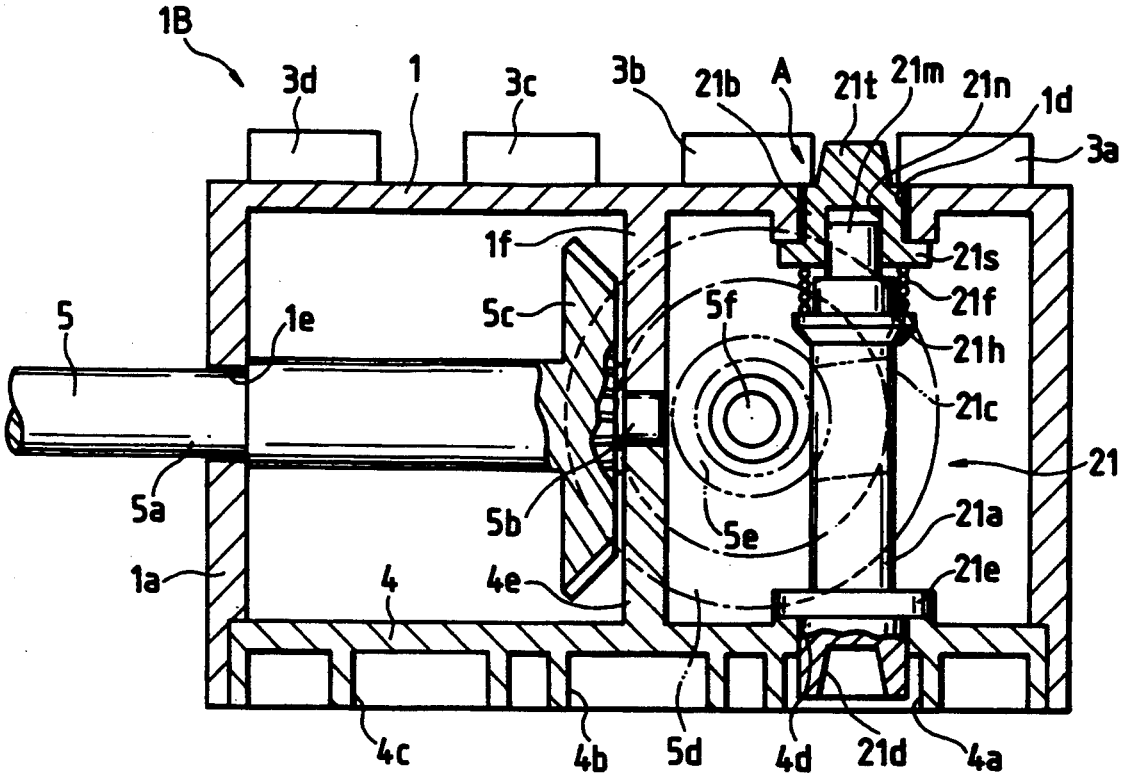
FIG. 4 is a vertical sectional view of the gear block unit of type B.

In each of the first, second and third embodiments shown in FIGS. 2, 4 and 5, both end portions of the rotary shaft (2, 21 or 22) are extended into the space A and in the tube 4*a*. However, it is obvious that the two end portions of the rotary shaft may be extended into the space B and the tube 4*b*, respectively.

One example of the combination of the block units will be described with reference to FIG. 7.

Figure 7:
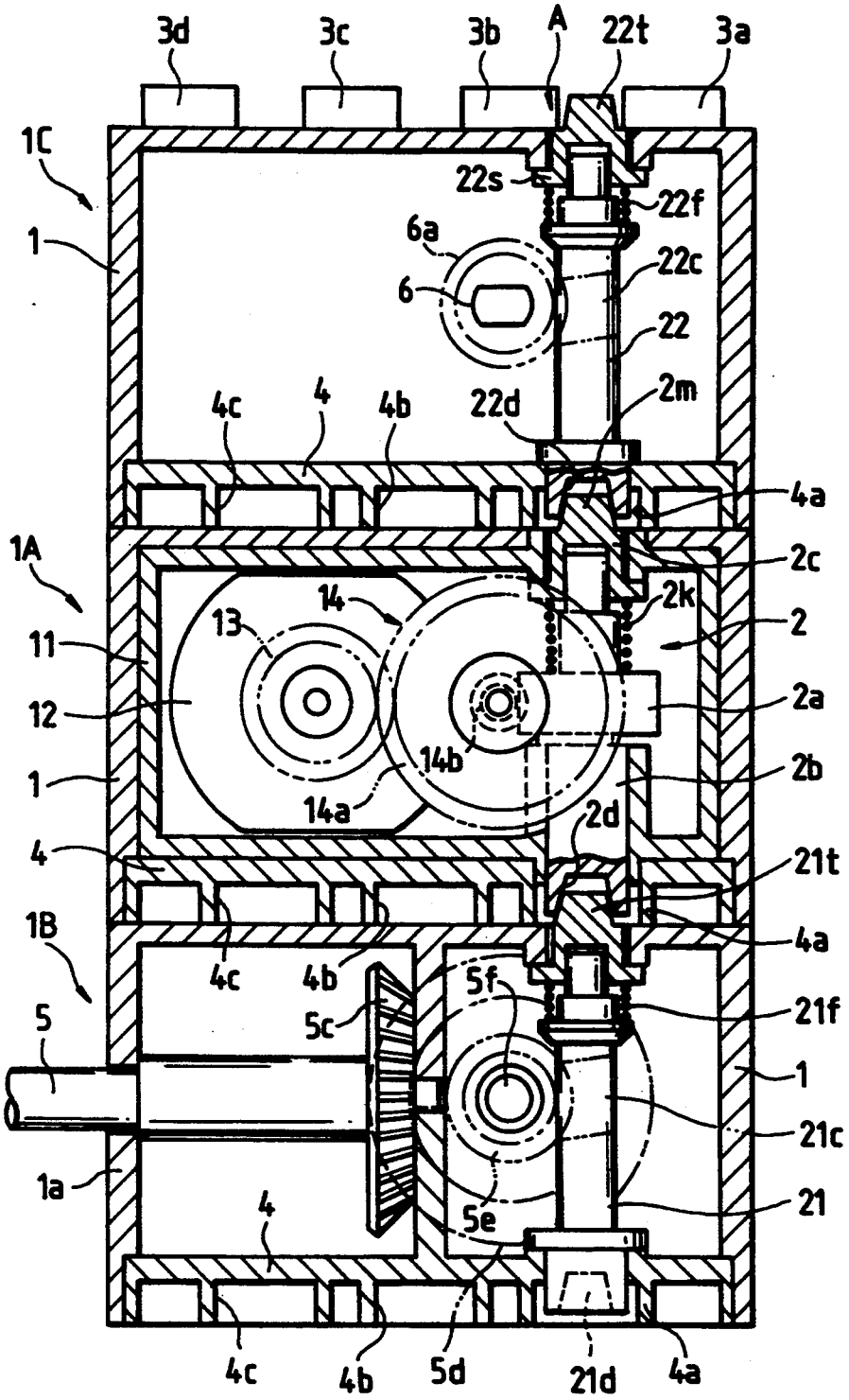
FIG. 7 is a vertical section view showing the assembly of the motor block unit, the gear block unit of type B, and the gear block unit of type C.

In FIG. 7, the block units 1A, 1B and 1C are connected to one another with the block unit 1A held at the middle. That is, the gear block unit 1C is set on the top of the motor block unit 1A, and on the bottom of which the gear block unit 1B is set. In this block connecting operation, the block units are connected one another by engaging the tubes 4*a*, 4*b* and 4*c* of the upper block unit with the spaces A, B and C of the lower block unit (cf. FIG. 1).

That is, the block units are connected together in the same manner as the conventional standard block units. However, even in the case where connection of the rotary shafts is not desired, the block units of the invention can be connected to one another, because in each of the block units both end portions of the rotary shaft are extended in the space A and the tube 4*a*, respectively.

In the case where the block units are combined so that the rotary shafts are connected to one another, the second rotation transmitting means 2*m* of the motor block unit 1A is taper-engaged with the first rotation transmitting means 22*d* of the gear block unit 1C, and the first rotation transmitting means 2*d* of the motor block unit 1A is taper-engaged with the second rotation transmitting means 21*t* of the gear block unit 1B.

The angle of the first rotation transmitting means 2*d* and 22*d* which are tapered holes are substantially equal to the angle of the second rotation transmitting means 2*m* and 21*t* trapezoid in section. Hence, the second rotation transmitting means 2*m* is taper-engaged with the first rotation transmitting means 22*d* after being inserted halfway into it, and the second rotation transmitting means 21*t* is also taper-engaged with the first rotation transmitting means 2*d* after being inserted halfway into it. In the rotary shafts 2, 21 and 22 each comprising the first and second shaft parts, the coil springs 2*k*, 21*f* and 22*f* urge the first and second shaft parts outwardly of the respective block bodies, to allow the block units to be connected together. Therefore, the rotation transmitting means are taper-engaged with one another while being pushed to one another.

The behavior of the rotary shaft 2 will be described, which is similar to those of the remaining rotary shafts 21 and 22. When the block units are coupled to one another through the protrusions and the pipes, the second shaft part 2*c* engaged with the first rotation transmitting means 22*d* is slightly pushed inwardly of the block body against the elastic force of the coil spring 2*k*, while the first shaft part 2*b* is pushed inwardly of the block body by the second rotation transmitting means 21*t*. That is, the two shaft parts 2*b* and 2*c* of the rotary shaft 2 are moved to reduce the length of the latter 2; that is, the coil spring 2*k* is compressed. The coil spring 2*k* thus compressed operates to push the first rotation transmitting means 2*d* against the second rotation transmitting means 21*t* and to push the second rotation transmitting means 2*m* against the first rotation transmitting means 22*d* of the block unit 1C, thus permitting a torque transmitting operation.

When the motor 12 in the motor block unit 1A combined with the other block units as shown in FIG. 7 is rotated, its torque is transmitted through the drive gear 13 to the large diameter gear 14*a* of the reduction gear unit 14. The rotation of the large diameter gear 14*a* is transmitted through the worm 14*b*, which is integral with the latter 14*a*, to the worm wheel 2*a*, so that the rotary shaft 2 is turned with the speed of rotation reduced. The rotation of the rotary shaft 2 is transmitted through the second rotation transmitting means 2*m* to the gear block unit 1C to turn the rotary shaft 22. The rotation of the rotary shaft 22 is outputted through the second rotation transmitting means 22*t*, or it is transmitted through the worm 22*c* and the worm wheel 6 to the output shaft 6 so that it is outputted through the latter 6 with the speed of rotation reduced.

On the other hand, the rotation of the rotary shaft 2 is transmitted through the first rotation transmitting means 2*d* to the second rotation transmitting means 21*t* of the gear block unit 1B, thus turning the rotary shaft 21 in the latter 1B. The rotation of the rotary shaft 21 is outputted through the first rotation transmitting means 21*d* as it is, or it is transmitted through the worm 21*c*, the worm wheel 5*e*, the bevel gear 5*d* and the bevel gear 5*c* to the output shaft 5, so that it is reduced in speed, being outputted through the output shaft 5. When an overload is applied to the rotary shafts coupled through the rotation transmitting means to one another, or to the rotating member connected to the rotary shafts, the first rotation transmitting means and the second transmitting means slip relative to each other to absorb the overload.

In the case where the block units are so set that the rotary shafts thereof lie in the block coupling direction, then the rotary shafts are connected to one another merely by connecting the block units to one another, and the output of the drive source can be obtained in all directions (three dimensional directions).

Figures 8A, 8B, 8C, 8D, 8E:
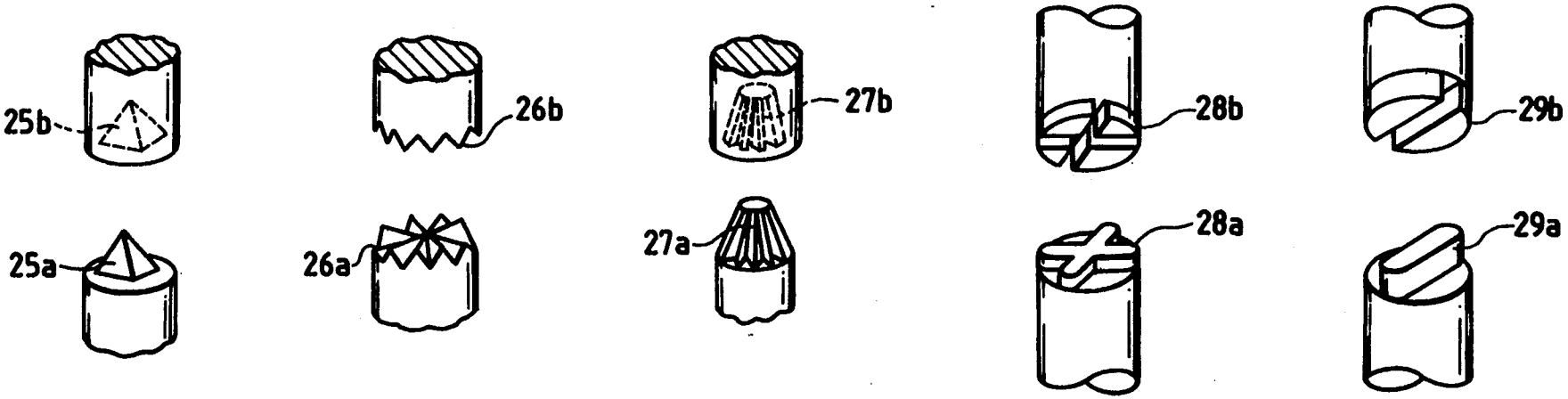
FIGS. 8(*a*) through (*e*) are perspective views showing a variety of rotation transmitting means.

The structures of the rotation transmitting means for coupling the rotary shafts to one another may be modified in various manners as shown in FIG. 8. FIG. 8(*a*) shows a pair of rotation transmitting means which have a pyramidal protrusion 25*a* and an engaging holes 25*a* pyramidal in section at the ends, respectively. FIG. 8(*b*) shows another pair of rotation transmitting means. One of the rotation transmitting means has an end face in which radial teeth are cut, and the other also has an end face which radial teeth are cut so as to be engaged with the radial teeth of the one rotation transmitting mans. FIG. 8(*c*) shows another pair of rotation transmitting means. One of the rotation transmitting means has an end portion which is formed into a circular-truncated-cone-shaped protrusion 27*a* with grooves, and the other has an end portion in the end face of which an engaging hole 27*b* is formed which is complementary in configuration with the protrusion 27*a*. In addition, pairs of rotation transmitting means as shown in FIG. 8(*d*) and (*e*) may be employed. The rotation transmitting means designed as described above are advantageous in the following point: Even if, in engaging the block units with each other, the rotary shafts are shifted in phase from each other; that is, the protrusion of the rotary shaft of one of the block units is shifted from the engaging hole of the rotary shaft of the other, the rotary shafts, being urged by the respective coil springs, are contracted to energize the coil springs, so that the block units are positively engaged with each other, and one of the rotary shafts is turned to positively engage with the other.

Figure 9:
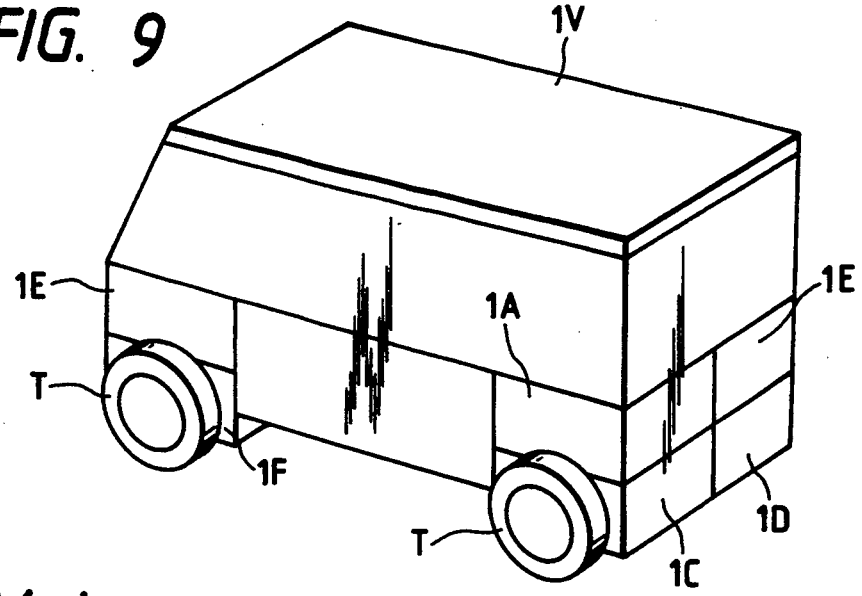
FIG. 9 is a perspective view showing an example of a block toy formed with the block units of the invention.
Figure 10A:
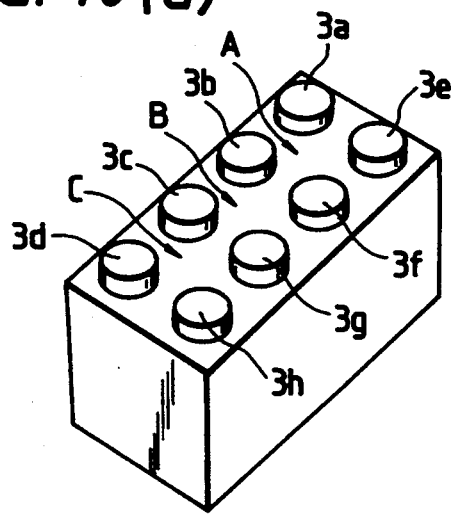
FIGS. 10 (*a*)–(*c*) are perspective views showing conventional gear block units.
Figure 10B:
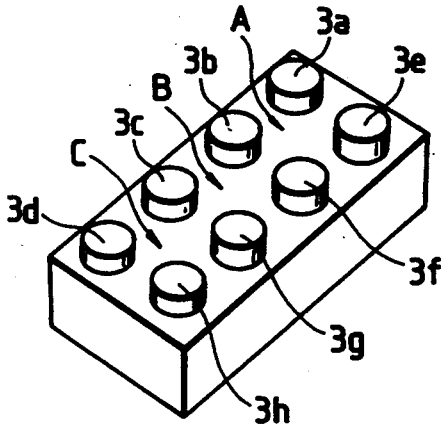
Figure 10C:
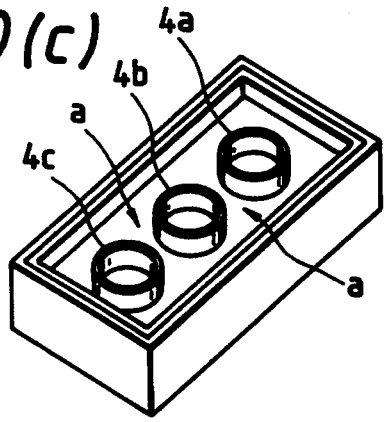

One example of a block toy simple in structure which is formed by combining the block units according to the invention will be described with reference to FIG. 9. In FIG. 9, reference character 1V denotes a battery block unit in which a power source, namely, a battery is loaded. The motor block unit 1A is connected to the lower surface of the battery block unit 1V, so that those block units 1V and 1A are electrically connected through terminals (not shown). The gear block unit 1C, on the output shaft 6 of which a tire T is mounted, is coupled to the lower surface of the unit 1A with the rotary shafts of the block units 1A and 1C connected to each other. The block unit 1D with another tire (not shown) is set beside the block unit 1C with their output shafts 6 connected to each other with a coupling pin (not shown). In FIG. 9, reference characters 1E and 1F designate conventional block units having no rotary shafts in them. Tires T are rotatably mounted on the block unit 1F. When the switch (not shown) is turned on, the motor in the motor block unit 1A is rotated. The rotation of the motor is transmitted to the tires T of the gear block units 1C and 1D to run the block toy. In place of each of the standard block units 1E, the block unit may be employed which has the rotary shaft built in it, and has the output shaft not protruded from the end wall or side wall of the block body.

If, in FIG. 9, the block units 1E are replaced with the motor block units 1A, then a motor-car toy of four-wheels drive type can be formed; that is, a block toy having a great driving force can be assembled. With the block unit having the output shaft extended in the block coupling direction, a block toy having a rotating member on its top as in the case of a helicopter toy can be assembled.

In each of the above-described embodiments, the drive source is the electric motor; however, the invention is not limited thereto or thereby. For instance, the drive source may be a spring motor, which outputs a driving force upon releasing the spring which has been wound up.

In the block unit according to the invention, the rotary shaft is extended in the block coupling direction. Therefore, when the block units are engaged with each other, the rotary shafts thereof are automatically engaged with each other. Furthermore, since the rotary shaft is not protruded outside the block body, the block unit can be handled safely, and the rotary shaft is prevented from being bent or broken.

In addition, in the block unit of the invention, the drive source is built in the conventional block body standard in size. Therefore, in the case where a block toy has been formed with the block units of the invention, the latter may be replaced with the conventional standard block units.

Furthermore, in the block unit of the invention, the rotation transmitting means are energized so as to be engaged with those of other block units. Hence, the torque is positively transmitted between the block units engaged with each other.

What is claimed is:

1. A block unit for a block toy, comprising:

a block body comprising an upper side and a lower side, said upper side including a plurality of protrusions which define at least one space therebetween, said lower side defining a recess portion, said block body being freely connectable to other block units through said plurality of protrusions and said recess portion;

a rotary shaft having opposite ends and being rotatably supported in the block body in such a manner that the rotary shaft is extended along an axis between said upper side and said lower side in a block coupling direction in which the block unit is coupled to other block units through said plurality of protrusions and said recess portion thereof; and rotation transmitting means for transmitting the rotation of the rotary shaft to other block bodies coupled to the block unit body, the rotation transmitting means provided at said opposite ends of the rotary shaft, the rotation transmitting means being freely connectable to rotation transmitting means of other block units, wherein said opposite ends of said rotary shaft, including said rotation transmitting means provided thereon, are set back so as not to protrude beyond end faces of said plurality of protrusions at said upper side nor beyond an exterior lower surface of said block body at said lower side, respectively.

2. A block unit as claimed in claim 1, further comprising:

drive means for rotating the rotary shaft provided in the block body.

3. A block unit as claimed in claim 1, in which the rotary shaft includes:

a first shaft member to which external torque is applied; and a second shaft member having an end portion engaged with the first shaft member in such a manner that the second shaft member is slidable axially and rotatable integrally with the first shaft member; and wherein said rotation transmitting means comprises:

first auxiliary rotation transmitting means for transmitting the external torque, the first auxiliary rotation transmitting means being formed on a side of one end portion of the first shaft member; and second auxiliary rotation transmitting means for transmitting the external torque, the second auxiliary rotation transmitting means being formed on a side of an other end portion of the second shaft member.

4. A block unit as claimed in claim 3, further comprising:

energizing means for energizing the first auxiliary rotation transmitting means and the second auxiliary rotation transmitting means so as to be coupled to those of other block units.

5. A block unit as claimed in claim 3, in which the first auxiliary rotation transmitting means includes an engaging hole.

6. A block unit as claimed in claim 5, in which the engaging hole is a conical hole trapezoidal in section.

7. A block unit as claimed in claim 4, in which the second auxiliary rotation transmitting means includes a protrusion.

8. A block unit as claimed in claim 7, in which the protrusion of the second auxiliary rotation transmitting means is conical, being trapezoidal in section.

9. A block unit as claimed in the claim 1, further comprising:

an output shaft arranged perpendicular to the rotary shaft.

10. A block unit as claimed in claim 1, wherein said rotary shaft extends into said at least one space at said upper side so as to be surrounded by said plurality of protrusions.

11. A block unit as claimed in claim 1, wherein the axis of said rotary shaft is offset with respect to a center of said block body, thereby to permit selective assembly of a plurality of block units without transmitting rotation of the rotary shaft.

* * * * *